US006302349B1

(12) United States Patent
Hermanns et al.

(10) Patent No.: US 6,302,349 B1
(45) Date of Patent: Oct. 16, 2001

(54) METHOD AND APPARATUS FOR MONITORING WINDING DENSITY IN PRODUCING RANDOM-WOUND YARN PACKAGES

(75) Inventors: Ferdinand Hermanns, Erkelenz (DE); Urs Meyer, Zürich (CH)

(73) Assignee: W. Schlafhorst, AG & Co. (DE)

( * ) Notice: Subject to any disclaimer, the term of this patent is extended or adjusted under 35 U.S.C. 154(b) by 0 days.

(21) Appl. No.: 08/883,833

(22) Filed: Jun. 26, 1997

(30) Foreign Application Priority Data

Jun. 26, 1996 (DE) ..... 196 25 511

(51) Int. Cl.[7] ..... B65H 54/00
(52) U.S. Cl. ..... 242/470
(58) Field of Search ..... 242/470

(56) References Cited

U.S. PATENT DOCUMENTS 4,805,844 * 2/1989 Hermanns et al. .
4,964,582 10/1990 Hermanns et al. .
5,141,169 8/1992 Sugioka .
5,954,289 * 9/1999 Hermanns et al. .

* cited by examiner

*Primary Examiner*—Michael R. Mansen
(74) *Attorney, Agent, or Firm*—Kennedy Covington Lobdell & Hickman, LLP

(57) ABSTRACT

Random wound yarn packages are produced at a winding station of a winding machine having a friction roller for driving the yarn package being wound by: winding yarn onto an initially empty bobbin core with the friction roller to form a finished random wound yarn package; and, during the winding, continuously (i) detecting with sensors a value representative of the angular velocity of the yarn package and a value representative of the angular velocity of the friction roller, and (ii) calculating a value representative of yarn application of the yarn package being wound, which is indicative of yarn package quality, based on the detected values. The yarn application value can be calculated based on a number of revolutions of the yarn package or based on a winding time of the winding process, and the yarn application values can be recorded as a function of time for later reference or display. Calculation of the diameter of the yarn package being wound is also provided, and yarn application values can be recorded as a function of the diameter. When the calculated diameter at least equals a threshold value, the winding process is stopped. Moreover, yarn application values are compared to set values and parameters of the winding process are adjusted if a deviation results, especially during patter winding zones.

16 Claims, 2 Drawing Sheets

METHOD AND APPARATUS FOR MONITORING WINDING DENSITY IN PRODUCING RANDOM-WOUND YARN PACKAGES

FIELD OF THE INVENTION

The invention relates to a method and an apparatus for the production of random wound yarn packages at a winding station of a winding machine having a friction roller for driving the yarn package and sensors for the continuous detection of values representative of the angular velocities of the friction roller and the yarn package and, in particular, relates to such a method and apparatus wherein a value representative of yarn application is calculated which is indicative of the winding density of the yarn package being wound.

BACKGROUND OF THE INVENTION

In German Patent Publication DE 42 39 579 A1, random wound yarn packages are produced at a winding station of a winding machine having a friction roller for driving the yarn package and sensors for the continuous detection and evaluation of the angular velocities of the friction roller and the yarn package. Specifically, this reference discloses the detection and evaluation of the angular velocities of the friction roller and the yarn package at a winding station for the detection of so-called pattern winding zones and the subsequent initiation of pattern disruption methods when pattern zones are detected in order to prevent or reduce pattern windings on the yarn package. However, the invention of German Patent Publication DE 42 39 579 A1 relates only to pattern windings and there exists a need for a method of monitoring the winding density of the yarn package during the winding operation.

OBJECTIVE AND SUMMARY OF THE INVENTION

It is an objective of the present invention to insure the quality of the yarn package produced at a winding station by monitoring the density of the yarn package as it is being wound and, if required, adjusting parameters of the winding process during the winding process in order to improve the yarn package quality.

Briefly summarized, the method of the present invention which obtains this objective includes continuously detecting during a winding process the angular velocities of the yarn package and the friction roller and calculating therefrom a value for the yarn application of the yarn package being wound.

As used in the present invention, "yarn application" is a mathematically defined herein as one-half the increase in the yarn package diameter (i.e., the increase in the radius of the yarn package) for each revolution of the yarn package during the course of the winding process, and yarn application can be expressed as a function of the number of revolutions of the yarn package or, alternatively, as a function of time. Yarn application is an important characteristic value representative of the quality of a yarn package because it indicates the winding density of the yarn package. For example, if the yarn application during a winding operation is substantially uniform and constant, the winding density will be substantially uniform and constant and the yarn package will have advantages over other yarn packages during further processing, such as during dyeing and, in particular, during unwinding.

In one feature of the present invention the yarn application values are recorded as a function of time and, alternatively, as a function of the yarn package diameter during the winding operation. This can be done, for example, by graphing the function simultaneously with the winding operation. It is also possible to store the yarn application values for later print out, or for later display of a graph thereof on a monitor so that the quality of a yarn package can be judged.

In a further feature of the present invention the diameter of the yarn package is calculated from the yarn application values and is compared with a threshold value corresponding to the maximum yarn package diameter to be produced, whereby the winding operation of the yarn package is stopped when the maximum yarn package diameter is reached. It is thereby possible to produce yarn packages having a uniform diameter.

In yet a further feature of the present invention the yarn application values are continuously compared to set values, at least in an area of a pattern winding zone, and if deviations are detected, the parameters of the winding operation are adjusted so that the yarn application values more closely match the set values. Thus, particularly in the area of a pattern winding zone, it is possible at least to reduce winding density fluctuations in this area so that a yarn package of improved quality can be produced.

The present invention also includes a winding station of a winding machine which performs the method of the present invention having a control and evaluation device that continuously detects and evaluates yarn application values during the winding process.

Further features and benefits of the present invention will become apparent to one of ordinary skill in the art from the following detailed description and from the drawings. For example, it should be recognized that in spite of a compensation of the contact force with which the yarn package rests on the friction roller during the winding process, and in spite of the regulation of the yarn tension at a constant value, both methods of which are conventionally known, relatively high density fluctuations nevertheless still occur, especially in the areas of pattern zones; an additional benefit of the present invention is that the yarn application values detected during pattern windings in the winding process indicate the effectiveness of a particular pattern disruption method used during a particular winding process.

DETAILED DESCRIPTION OF THE PREFERRED EMBODIMENT

Figure 1:
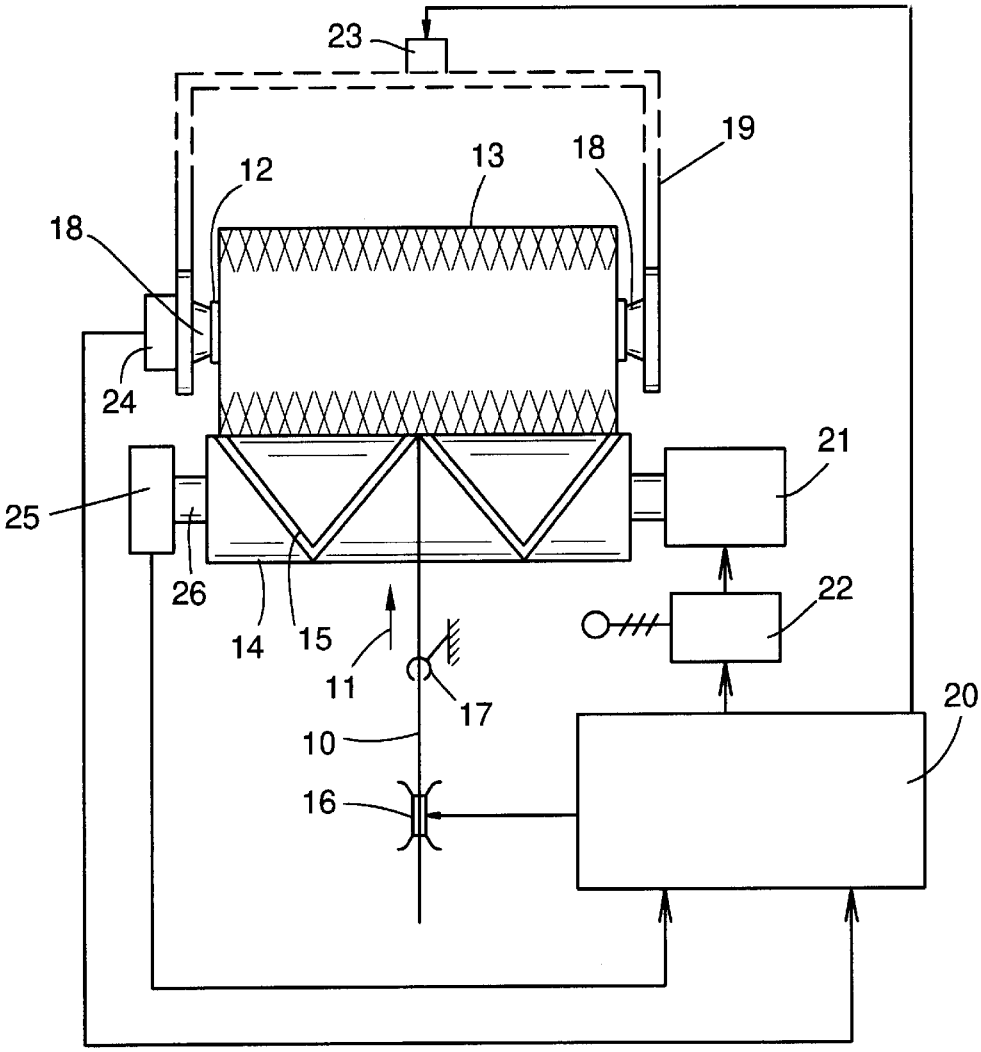
FIG. 1 is a schematic representation of a winding station of a winding machine which includes a control and evaluation device that performs the method of the present invention.
Figure 2:
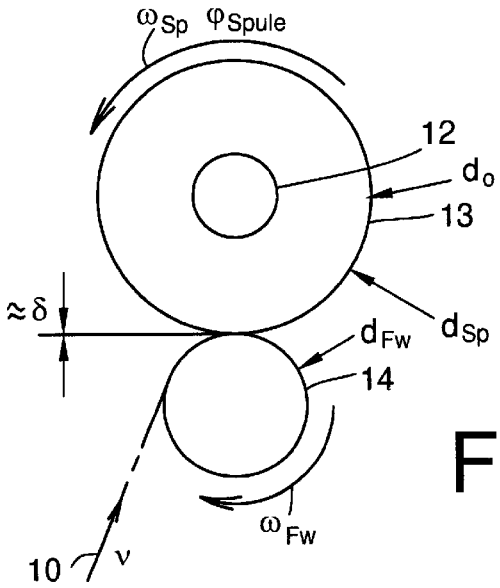
FIG. 2 is a schematic representation of a friction roller and a yarn package driven by the friction roller at the winding station of FIG. 1.

With reference to FIG. 1, a yarn 10 is drawn in the direction of the arrow 11 and is wound on a bobbin core 12 to form a cylindrical yarn package 13 at a yarn package winding station of a winding machine. The cylindrical yarn package 13 rests on a friction roller 14, which is provided with a reversing groove 15 whereby the friction roller 14 simultaneously acts as a traversing guide. The yarn 10 runs over an adjustable and/or controllable yarn tensioner 16 to a yarn guide ring 17 and thereafter to the reversing groove 15 of the friction roller 14.

The yarn package 13 is held by cone plates 18, which project into the bobbin core 12 and rotate with the bobbin core 12 and therefore with the yarn package 13. The cone plates 18 are rotatably seated in a bobbin frame 19 whereby the yarn package 13 is held by a preselectable force against the friction roller 14.

The winding station includes an evaluation and control device 20 which regulates the velocity of a drive motor 21 embodied as an asynchronous motor that drives the friction roller 14 through, for example, an inverted rectifier 22 connected to the drive motor 21. The evaluation and control device 20 also regulates the adjustable yarn tensioner 16, represented only schematically, so that the yarn tensioner 16 can be set and, in particular, adjusted to maintain a constant tension on the yarn during the winding process.

The bobbin winding frame 19 is provided with a device 23, only represented schematically, which generates the contact force with which the yarn packages 13 rests upon the friction roller 14. The device 23 can operate autonomously, i.e., automatically maintain an at least approximate constant contact force as a function of the yarn package diameter. However, in the preferred embodiment of the present invention, a substantially constant contact force is maintained by the evaluation and control device 20 through direct control of the device 23.

The winding station includes angle of rotation sensors 24,25 associated with one cone plate 18 and the shaft 26 of the friction roller 14, respectively, each of which is connected to the evaluation and control device 20 for communication therewith.

In defined diameter conditions of the friction roller 14 and the yarn package 13, which can be calculated in advance, so-called pattern winding zones, patterns or lozenges occur which can be particularly troublesome in later unwinding of the yarn 10 from the yarn package 13. Pattern disruption methods are therefore employed which prevent such patterns or lozenges or, at least, reduce the negative effects of the patterns or lozenges. For instance, a conventional pattern disruption method includes alternately accelerating the friction roller 14 so that slippage occurs between the friction roller 14 and the yarn package 13, and then decelerating the friction roller 14 so that no slippage occurs between the friction roller 14 and the yarn package 13. However, even in spite of such a pattern disruption method, a relatively substantial increase in the winding density of the yarn package occurs in the area of the pattern zone which continues to adversely affect the unwinding behavior of the yarn package 13.

Information regarding the size and/or the course of fluctuations in the winding density in a yarn package is advantageous, since this information can be used in further processing such as dyeing or unwinding, and since this information is indicative of the quality of the yarn package. Furthermore, the monitoring of the winding density during the winding process results in particular advantages if, on the basis of detected values of yarn application, interventions in the winding process are made (such as adjustments to parameters of the winding process), even if only for at least reducing fluctuations in the winding density.

The present invention is based on the concept that values representative of yarn application for a winding process directly indicate the winding density of the yarn package being wound. For example, if the values representative of yarn application decrease during a winding process while the winding conditions per se remain the same, then it can be concluded that the winding density has increased. Conversely, an increase in the values representative of yarn application corresponds to a decrease in the winding density. Thus, the values representative of yarn application determined continuously throughout the winding process, i.e., from the winding of the yarn (or thread) on an initially empty bobbin core 12 until a finished yarn package is produced, are an important characteristic of a yarn package indicative of its quality. The present invention provides a method and apparatus wherein values representative of yarn application can be continuously detected, evaluated and monitored during the winding process, as now explained in detail.

Theoretically, the detection of a value representative of yarn application is relatively simple when using the following equation (Eq. #1):

$$d_{sp} = \frac{\omega_{FW}}{\omega_{sp}} \times d_{FW}$$

where:

$d_{sp}$ is the (instantaneous) diameter of the yarn package 13;

$d_{FW}$ is the diameter of the friction roller 14 (which has a known constant value);

$\omega_{FW}$ is the angular velocity of the friction roller 14; and $\omega_{sp}$ is the angular velocity of the yarn package 13.

The yarn application "δ" corresponds to one-half of the diameter change after one revolution. Thus, the calculation of δ based on Eq. #1 does not lead to a usable result since the yarn application δ per yarn package revolution is extremely small in comparison with the yarn package diameter; because of the noise of the measured values it is not possible to detect the yarn application δ in this way.

A second equation (Eq. #2a) is used for calculating the yarn application δ as a function of the yarn package revolution:

$$d_{sp} - d_o + 2 \times \delta_i \times n_{sp}$$

where:

$d_{sp}$ is the instantaneous diameter of the yarn package 13;

$d_o$ is the previously calculated diameter of the yarn package 13;

$\delta_i$ is the instantaneous yarn application; and $n_{sp}$ is the number of revolutions of the yarn package 13 occurring after the previously calculated diameter $d_o$.

A mathematical filter is developed from Eq. #2a into which the result of Eq. #1 and the number of revolutions $n_{sp}$ are inserted. This mathematical filter then provides the respective values for $d_o$ and for yarn application $\delta_i$ using a technique in which the sum of the squares of the errors of the measured diameter values becomes insignificant with respect to predicted diameter values.

This evaluation is now explained in further detail with reference to FIG. 3. Furthermore, it is to be understood that since the method and apparatus of the present invention can be used with cylindrical yarn packages 13 as well as conical yarn packages 13', a conical yarn package 13' is indicated in connection with the friction roller 14 in FIG. 3.

Figure 3:
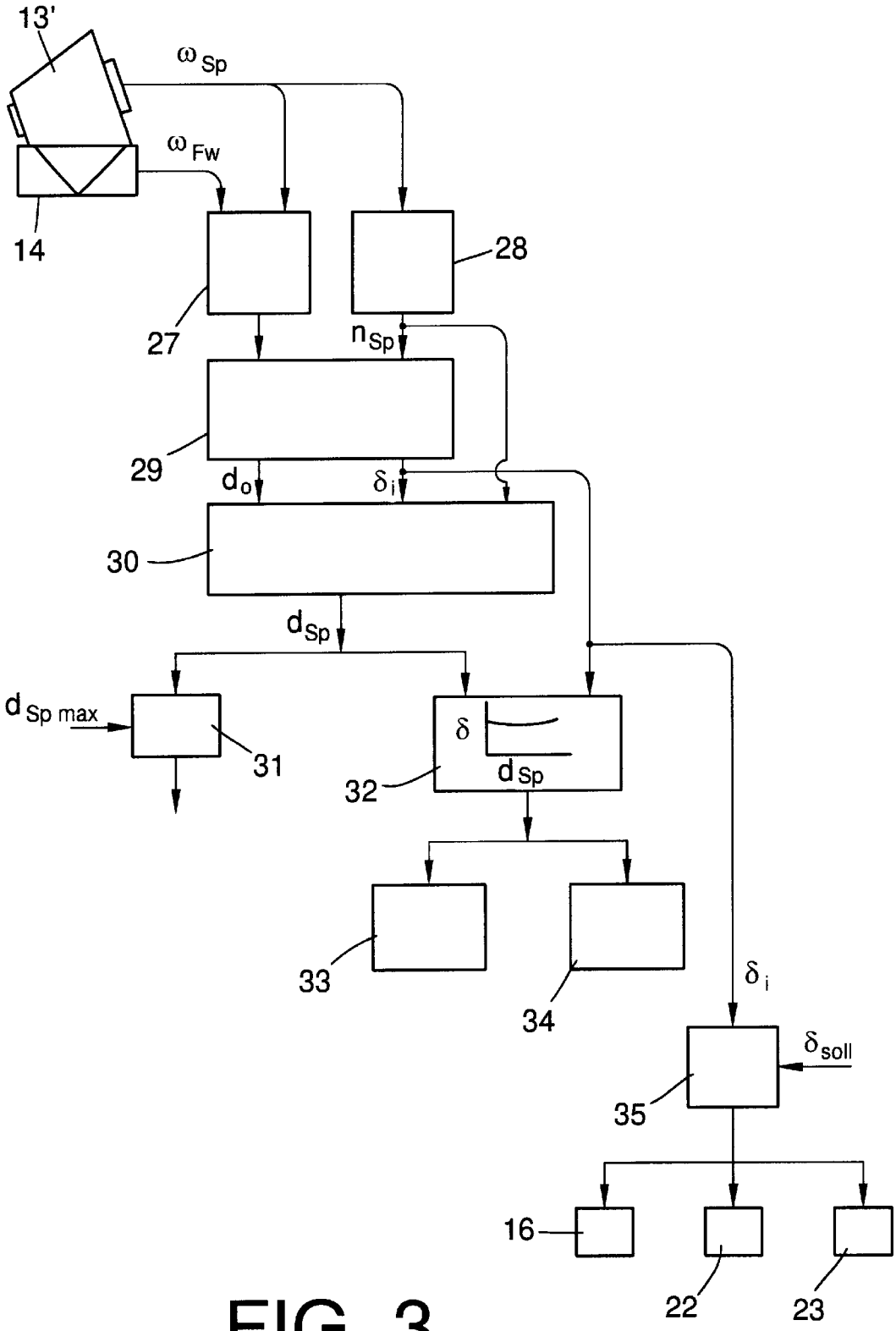
FIG. 3 is a block diagram illustrating the control and evaluation device of FIG. 1.

In FIG. 3 the angle sensors 24, 25 detect the angular velocity $\omega_{sp}$ of the yarn package and the angular velocity $\omega_{FW}$ of the friction roller 14. The diameter $d_{sp}$ of the yarn package 13' is calculated in accordance with Eq. #1 in an evaluation device 27. (In connection with a conical yarn package 13', the diameter $d_{sp}$ is the driven diameter, i.e., the diameter at which there is no slippage between the yarn package and the friction roller). Furthermore, since the diameter $d_{FW}$ of the friction roller 14 is constant, multiplication with this value may be omitted. The number of revolutions is counted in a revolution counter 28 on the basis of the angular velocity $\omega_{sp}$ of the yarn package 13'. The values from the revolution counter 28 and the evaluation device 27 are entered into a mathematical filter 29, for example a Kalman filter, which is based upon Eq. #2a. This filter 29 thereby calculates the yarn application $\delta_i$ and also provides the yarn package diameter $d_o$ in accordance with the latest calculation. The diameter $d_{sp}$ is calculated in a downstream evaluation unit 30 according to Eq. #2a, wherein the value of the revolution counter 28 is also entered.

During the winding process, periods of time occur in which it is unlikely that the winding density will change by any appreciable amount. Experience therefore has shown that the detection of the yarn package diameter $d_{sp}$ and yarn application $\delta_i$ can be limited to known periods of time when the winding density is likely to change by an appreciable amount.

The values $d_{sp}$ and $\delta_i$ obtained in the above manner can be evaluated in several ways. For example, the measured diameter $d_{sp}$ can be compared with a maximum value $d_{spmax}$ in a comparator device 31 which, if $d_{sp}$ at least equals $d_{spmax}$, outputs a signal that ends the winding process of the finished yarn package 13'.

The values $d_{sp}$ and $\delta_i$ are also provided to a device 32 for recordation, for example memory, in which the yarn application $\delta_i$ over the diameter $d_{sp}$ of the yarn package 13' is recorded. When needed, the values recorded in the device 32 can be forwarded to a printer 33. The values can also be forwarded to a display screen 34 and graphically displayed there.

As further shown in FIG. 3, the actual value $\delta_i$ of the yarn application can also be forwarded to a comparator device 35, which compares the actual value $\delta_i$ with a set value $\delta_{soll}$. If the value of $\delta_i$ is less than the set value $\delta_{soll}$, then the yarn package 13' being wound has too high a winding density. In this case the comparator device 35 outputs an intervention signal that acts on the yarn tensioner 16 and/or the inverted rectifier 22 of the drive motor 21 in order to reduce the yarn tension by partially opening the yarn tensioner 16 and/or reducing the rpm of the drive motor 21. The signal of the comparator device 35 can also be supplied simultaneously or alternativelly to the device 23 in order to reduce the contact force between the yarn package 13' and the friction roller 14 thereby also reducing the winding density. The set value $\delta_{soll}$ can be preset or determined during the winding process based on values determined in the areas outside of the pattern winding zones in which yarn application $\delta$ is relatively constant. Since an intervention in the winding process in most cases is only necessary in the area of the pattern zones, and even then typically only with pattern winding zones at larger yarn package diameters, the comparator device 35 is perferably only used in the area of such pattern winding zones. To this end it is possible to evaluate the signals of the angular rotation sensors 24, 25 to detect the area of a pattern winding zone as is known from German Patent Publication DE 42 39 579 A1, for example.

It has been shown above how the actual values $\delta_i$ of the yarn application are continuously determined during a winding process while evaluating the angular velocities $\omega_{sp}$ of the yarn package and $\omega^{FW}$ of the friction roller detected by the angular rotation sensors 24,25. A corresponding evaluation is of course also possible if the period lengths or frequencies of the yarn package and friction roller are detected. To the extent that detection of a value representative of angular velocity is discussed herein, this representative value is to be understood as being synonyms for angular velocity as well as period and frequency. Thus, the detection of the period or frequency of the yarn package or friction roller is considered the equivalent of the detection of the angular velocity for purposes of the present invention.

The diameter $d_{sp}$ of a yarn package can also be expressed as a function of time rather than as a function of the number of revolutions of the yarn package in accordance with equation (Eq. #2b):

$$d_{sp} = \sqrt{d_o^2 + \frac{4}{\pi}\delta v t}$$

Equation #2b is obtained from the dependence of the diameter $d_{sp}$ of the yarn package 13 from the angle of rotation of the bobbin, to which the following applies:

$$d_{sp} = d_o + \frac{2}{2\pi}\delta \times \varphi(t)$$

Here, $\phi(t)$ is the angle of rotation (in radians) of the yarn package as a function of time. If this equation is differentiated in accordance with time, the result is $$\dot{d}_{sp} = 1/\Pi\delta \times \dot{\phi}(t)$$

The differentiation $\phi(t)$ is the angular velocity $\omega(t)$ of the yarn package 13, so that the following applies $$\dot{d}_{sp} = 1/\Pi\delta \times \omega(t)$$

Since:

$$d_{sp} = 2\frac{v}{\omega(t)}$$

then:

$$\dot{d}_{sp} = -2v \times \frac{\omega(\dot{t})}{\omega^2(t)}$$

and thus:

$$-2\frac{v \times \omega(\dot{t})}{\omega^2(t)} = \frac{\delta \times \omega(t)}{\pi}$$

where $v$ is the circuferential velocity of the yarn package.

If this equation is integrated over $\omega$ and t and, in addition, the following is inserted:

$$\omega_o = \frac{2 \times v}{d_o}$$

the result is:

$$\omega(t) = \frac{v}{\sqrt{d_o^2 + \frac{4}{\pi}\delta v t}}$$

Provided that the circumferential speed of the friction roller matches the circumferential speed of the yarn package, then:

$$d_{sp} = \frac{\omega_{FW}}{\omega_{sp}} \times d_{FW}$$

from which the following results:

$$d_{sp} = \sqrt{d_o^2 + \frac{4}{\pi}\delta v t}$$

which is Eq. #2b, where v is the known circumferential speed of the friction roller 14.

If the instantaneous bobbin diameter $d_{sp}$ and the instantaneous yarn application $\delta_i$ over time is determined in accordance with Eq. #2b, then in modification of FIG. 3 a time measuring device is provided in place of a revolution counter 28 and the mathematical filter 29 is developed based on Eq. #2b instead of Eq. #2a.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for producing random wound yarn packages at a winding station of a winding machine having a friction roller for driving the yarn package being wound, comprising:

a. winding yarn onto an initially empty bobbin core with the friction roller to form a finished random wound yarn package;

b. during said winding continuously:

i. detecting with sensors a value representative of the angular velocity of the yarn package and a value representative of the angular velocity of the friction roller, and ii. calculating a value representative of yarn application of the yarn package being wound based on said detected values; and c. controlling the winding density of the yarn package being wound based on the calculated yarn application value.

2. The method in accordance with claim 1, further comprising calculating each value representative of yarn application based on a number of revolutions of the yarn package.

3. The method in accordance with claim 1, further comprising calculating each value representative of yarn application based on a winding time of the winding process.

4. The method in accordance with claim 1, further comprising recording each said calculated value representative of yarn application as a function of time.

5. The method in accordance with claim 1, further comprising recording each said calculated value representative of yarn application as a function of the yarn package diameter.

6. The method in accordance with claim 1, further comprising:

calculating a diameter of the yarn package being wound based on said calculated values representative of yarn application;

comparing said calculated diameter with a threshold value corresponding to a maximum diameter of the finished yarn package to be produced; and ending the winding process when said calculated diameter at least equals the threshold value.

7. The method in accordance with claim 1, further comprising:

comparing to a set value a said calculated value representative of yarn application during at least one pattern winding zone of the winding process; and if said calculated value substantially deviates from said set value, then adjusting winding parameters of the winding process whereby a subsequent said calculated value deviates to a lesser extent from said set value.

8. The method in accordance with claim 1, wherein the step of controlling the winding density of the yarn package being wound based on at least one of said continuously-calculatad yarn application values includes adjusting the tension of the yarn being wound onto the yarn package.

9. An apparatus for producing random wound yarn packages at a winding station of a winding machine comprising:

a friction roller for driving a yarn package;

a sensor that detects a value representative of angular velocity of the friction roller;

a sensor that detects a value representative of angular velocity of the yarn package; and a control and evaluation device connected to said sensors for communication therewith, said device including:

means for calculating a value representative of yarn application of the yarn package being wound based on said detected values, and means for controlling the winding density of the yarn package being wound based on the calculated yarn application value.

10. The apparatus in accordance with claim 9, further comprising means for counting the number of revolutions of the yarn package, wherein said calculating means calculates said value representative of yarn application based on a number of revolutions of the yarn package.

11. The apparatus in accordance with claim 9, further comprising means for counting a winding time of the winding process, wherein said calculating means calculates said value representative of yarn application based on a winding time.

12. The apparatus in accordance with claim 9, further comprising means for calculating a diameter of the yarn package, for comparing said calculated diameter with a maximum value, and for ending the winding process when said calculated value at least equals said maximum value.

13. The apparatus in accordance with claim 9, further comprising means for recording said calculated value.

14. The apparatus in accordance with claim 12, further comprising means for graphically displaying said calculated value.

15. The apparatus in accordance with claim 9, further comprising means for comparing said calculated value representative of yarn application with a set value and for modifying parameters of the winding process if a substantial deviation occurs between said calculated value and said set value.

16. The apparatus in accordance with claim 9, wherein the means for controlling the winding density of the yarn package being wound based on the calculated yarn application value includes means for adjusting the tension of the yarn being wound onto the yarn package.

* * * * *